United States Patent [19]

Heijnemans et al.

[11] 4,242,612

[45] Dec. 30, 1980

[54] DEFLECTION UNIT FOR COLOR TELEVISION DISPLAY TUBES

[75] Inventors: Werner A. L. Heijnemans; Joris A. M. Nieuwendijk; Nicolaas G. Vink, all of Eindhoven, Netherlands

[73] Assignee: U.S. Philips Corporation, New York, N.Y.

[21] Appl. No.: 8,663

[22] Filed: Feb. 2, 1979

[30] Foreign Application Priority Data

Feb. 6, 1978 [NL] Netherlands ..... 7801316

[51] Int. Cl.[3] ..... H01F 3/00

[52] U.S. Cl. ..... 313/421; 335/210; 335/213

[58] Field of Search ..... 313/421, 426, 431, 440; 335/210–213; 315/399, 400

[56] References Cited

U.S. PATENT DOCUMENTS

| | | | |
|---|---|---|---|
| 3,162,791 | 2/1963 | Gostyn | 335/213 |
| 3,849,749 | 11/1974 | Kadota | 335/210 |
| 4,096,462 | 6/1978 | Akatsu et al. | 335/213 |
| 4,143,345 | 3/1979 | Barkow | 335/212 |

*Primary Examiner*—Eugene R. LaRoche

*Attorney, Agent, or Firm*—Thomas A. Briody; William J. Streeter; Edward W. Goodman

[57] ABSTRACT

In a deflection unit for in-line color television display tubes, flux altering elements are provided between the field and line deflection coils, near the center of the field deflection coil, the flux altering means extending substantially parallel to the field deflection field. As a result of these measures, such a deflection unit combines a good astigmatism level with an acceptably small frame coma error and a reduced EW-frame distortion.

5 Claims, 11 Drawing Figures

DEFLECTION UNIT FOR COLOR TELEVISION DISPLAY TUBES

BACKGROUND OF THE INVENTION

The invention relates to a deflection unit for a color television display tube, which deflection unit has a field deflection coil, a line deflection coil, and an annular member of soft-magnetic material surrounding at least the line deflection coil. A line deflection coil is to be understood to mean, in this context a combination consisting of two diametrically oppositely arranged coil portions for deflection an electron beam in a first (horizontal) direction, and a field deflection coil is to be understood to mean, in this context a combination consisting of two diametrically oppositely arranged field coil portions for deflecting an electron beam in a (vertical) direction, transverse to the first direction. Each deflection coil portion may be of the saddle type and may consist of electrical conductors which are wound so as to form a first and a second side strip, a front and a rear end which together define a window, at least the front end being constructed as an upright edge (flange), the line and field deflection coils being surrounded by the annular member of soft-magnetic material (the core); or the line deflection coil portions may be of the saddle type and the line deflection coil may be surrounded by the core, while the field coil portions are wound toroidally on the core, this latter case being a hybrid system.

For displaying (color) television pictures, certain electro-optical requirements are imposed upon the combination of the display tube and the electron beam deflection device.

It holds, for example, that the raster reproduced on the display screen must be rectangular and undistorted within certain narrow limits. Furthermore the definition of the picture from the center towards the edge of the screen may decrease only to a restricted non-disturbing extent.

For the color display tube having a shadow mask there are two additional requirements.

The color selection in a shadow mask tube is obtained by an eccentric arrangement of the three electron guns in such manner that the phosphor dots of a given color are hit only by the electrons of the corresponding beam through the holes in the mask. In order to obtain a color-pure image it is required that the relative color selection angles of the three beams should remain unvaried upon deflection. This is the landing requirement. When this condition is not satisfied, it is possible that color spots will occur.

A second equally important requirement is that the targets of the three electron beams should coincide with each other throughout the screen so that the pictures in the three primary colors fully converge. This is the convergence requirement. When this condition is not satisfied, disturbing color edges at brightness and color transitions occur.

Of great importance in the further development of color television display systems was the introduction of the "in-line gun" display tube in which the electron guns are arranged in one plane. The basic idea of this design is that it must be possible with this arrangement to obtain automatic convergence (self-convergence) throughout the display screen while using astigmatic deflection fields. A correct astigmatism level for the field deflection coil will be described hereinafter.

Fora good astigmatism level for the field deflection coil, its magnetic field should show a barrel-shaped variation in the middle and on the screen side of the deflection unit. If this variation is realised with a set of conventional (straight-wound) toroidal field deflection coil portions or with a set of conventional saddle-shaped field deflection coil portions (having a constant average window opening), then this means necessarily that the produced magnetic field has a barrel-shaped variation everywhere, so also on the gun side. "Straight wound" is understood to mean herein that the turns constituting the coil portions are located in planes passing through the longitudinal axis of the core. since it is usual to position the three electron guns in the sequence red, greed, blue, this has for its result that, during the deflection, the green beam lags with respect to the average of the red beam and the blue beam. This deflection error is termed coma.

In itself it is possible to mitigate coma by winding the field deflection coil portions in a special manner: for this purpose, a tororidal field deflection coil portion should be wound "obliquely", and a saddle-shaped field deflection coil portion should be wound so that the average window opening varies in the axial direction.

However, the disadvantage of this solution is that, apart from the more complicated winding process, it introduces substantial East-West raster distortion.

SUMMARY OF THE INVENTION

It is the object of the invention to provide a deflection unit of the kind mentioned in the preamble which couples a good astigmatism level with an acceptably small coma error and in which a considerably smaller EW-frame distortion occurs than in the conventional deflection units.

For that purpose, the deflection unit according to the invention is characterized in that the field deflection coil has been wound so that, when the deflection unit is mounted on a display tube having a neck portion, a display screen and an intermediately located cup-shaped outer surface, upon energisation, it produces a strong pin cushion-shaped field on its neck side and produces a substantially homogeneous flux on its screen side, and is combined with field-altering means to produce a pronounced barrel-shaped field in its center.

As will be explained in detail hereinafter, the requirements imposed as regards astigmatism level, coma error, and EW-raster distortion, can be fully satisfied by means of a deflection unit as described above. Notably, the substantially homogeneous (i.e. weakly barrel-shaped or pin cushion-shaped, or possibly undistorted) field on the screen side causes the resulting EW-raster distortion of the deflection unit as a whole to be considerably less pin cushion-shaped than that of the conventional deflection units.

A preferred embodiment of the deflection unit in accordance with the invention which is very easy to realise is characterized in that the flux altering means comprise two soft-magnetic elements which are accommodated diametrically opposite to each other between the filed and the line deflection coil, substantially parallel to the magnetic field of the field deflection coil, near the center of the field deflection coil. It is essential that the soft-magnetic elements, viewed from the longitudinal axis of the deflection unit, be situated outside the line deflection coil so that they do not influence or hardly influence the line deflection field.

The construction of the flux altering means as flat or slightly curved sheets of soft-magnetic material makes it possible to assemble them in a simple manner between the line and field deflection coils.

DESCRIPTION OF THE DRAWINGS

The invention which also relates to a combination of a deflection unit as described above with a color display tube will now be described in greater detail, by way of example, with reference to the drawings, in which.

DESCRIPTION OF THE PREFERRED EMBODIMENT

Figure 1:
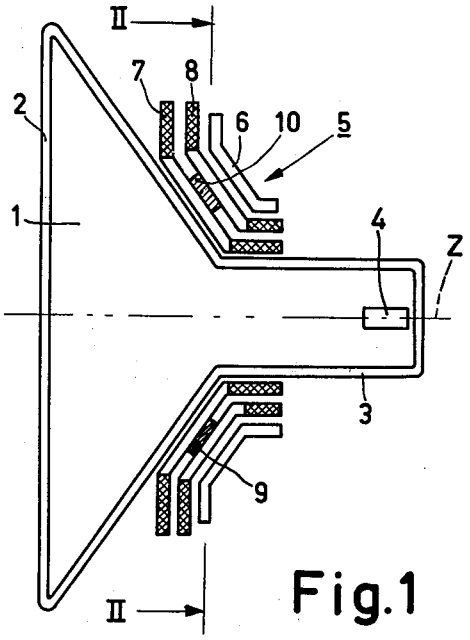
FIG. 1 is a diagrammatic longitudinal sectional view of a color television display tube having a deflection unit according to the invention.
Figure 2:
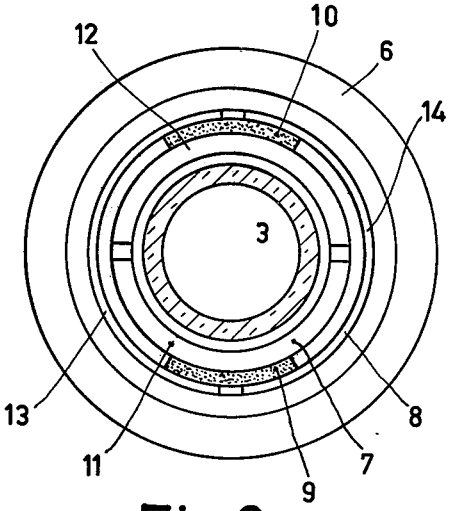
FIG. 2 is a diagrammatic elevation of a cross-sectional view of the color display tube and the deflection unit shown in FIG. 1 taken on the line II-13 II.

FIGS. 1 and 2 show a color display tube 1 having a display screen 2, a neck 3 and an electron gun assembly 4. An electron beam deflection unit 5 is mounted on the display tube 1. The deflection unit 5 comprises an annular core member 6 of magnetically permeable material which encloses a line deflection coil 7 and a field deflection coil 8. The deflection coils 7 and 8 in the present case consist of a pair of coils 11, 12 and 13, 14, respectively, of the so-called shell type, that is to say that their rear ends (flanges) (that is to say the ends most adjacent to the neck 3 of the display tube 1) extend parallel to the longitudinal axis Z of the display tube 1. However, the invention is not restricted to the use of this type of saddle coil.

Figure 3:
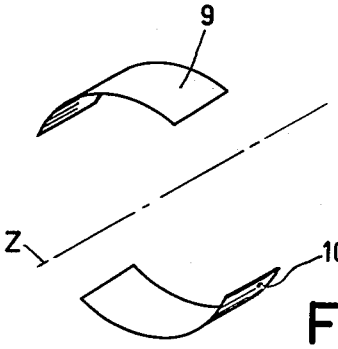
FIG. 3 is a perspective view of the flux-altering elements shown in FIGS. 1 and 2.
Figure 4:
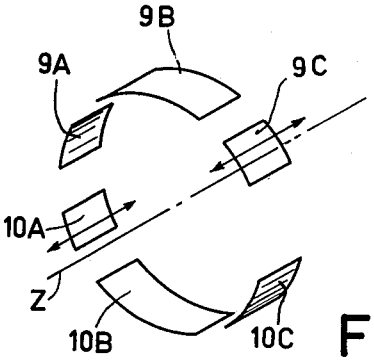
FIG. 4 is a view corresponding to that of FIG. 3 but showing an alternative construction.

Within the scope of the invention, segments 9 and 10 of soft-magnetic material are arranged between the deflection coils 7 and 8 in such manner that segment 9 is associated with field deflection coil portion 11 and segment 10 is associated with field deflection coil portion 12. As a result of this, the segments 9 and 10 extend substantially parallel to the field of the field deflection coil 8. While FIG. 3 shows segments 9 and 10 each consisting of one piece (in which the dimension of the segments in the Z direction is, for example, 14 mm for a deflection unit for a 110° display tube having a 26 inch display screen), it has been found possible to separately influence certain field gradients if each segment 9 and 10 is divided into an equal number of separate sections, for example, 9A, 9B, 9C and 10A, 10B, 10C (FIG. 4). The segments 9A, 9C and 10A, 10C and the segments 9B and 10B, respectively, have the same shape and are positioned symmetrically with respect to the Z-axis. If desired, only the segments 9A, 9C and 10A, 10C may be used, while omitting the sections 9B and 10B, so that only correction of higher-order errors takes place. A further possibility in this connection is to move the segments in the Z-direction relative to each other. The segments may in general be manufactured from any soft-magnetic material having a permeability $>100$. The effect of the segments will be explained in detail hereinafter.

Figure 5:
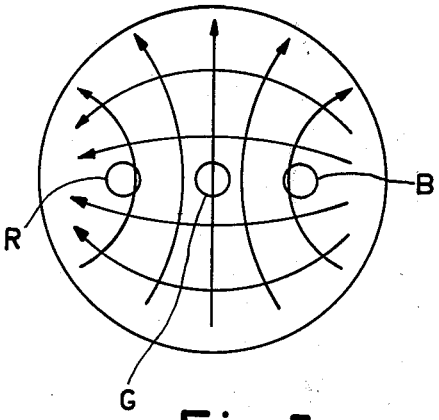
FIG. 5 shows diagrammatically the deflection fields on the screen side of a conventional in-line gun deflection unit.

When an in-line color display tube is combined with a deflection unit of the astigmatic type which has a magnetic field distribution in which, as shown in FIG. 5, that due to the field deflection coil is barrel-shaped and that due to the line-deflection coil is cushion-shaped, automatic convergence without any form of dynamic correction is possible in principle.

Figure 6:
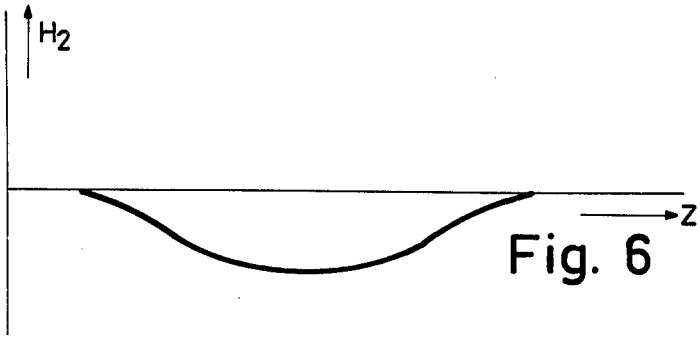
FIGS. 6 and 7 are graphic representation of the value of the parameter $H_2$ along the Z-axis of display tubes having conventional deflection units.

In order to obtain a good astigmatism level for the field deflection coil, the magnetic field generated by that coil should have a barrel-shaped variation in the center and on the screen side of the deflection unit. In the case of straight-wound toroidal frame deflection coil portions this means necessarily that the magnetic field has a barrel-shaped variation everywhere, hence also on the gun side. As a result of this, in this case, upon deflection, the green beam will lag with respect to the average of the red beam (R) and the blue beam (B). (FIG. 5). This deflection error is termed coma. If the amount of pin-cushion or barrel-shape of the field of the field deflection coil as a function of the axial position is described by means of the parameter $H_2$, known from the technical literature, a variation as shown in FIG. 6 is formed for straight-wound toroidal frame deflection coil portions. For a positive $H_2$ the field configuration in a plane perpendicular to the Z-axis is cushion-shaped and for a negative $H_2$ is barrel-shaped. For the description and the measuring of $H_2$, reference is made to the article by R. Vonk in Philips Technical Review, volume 32, 1971, No. 3/4, pp. 61–72. For a coma-free magnetic field the value of $h_2$ integrated in the axial direction must be small. For straight-wound toroidal frame deflection coil portions, however, this value is considerable.

The raster defects as they are generated by a deflection unit are determined in particular by the shape of the deflecting fields at the screen end of the unit.

A barrel-shaped variation of the magnetic field of the field deflection coil in this area stimulates a pin cushion-shaped EW-raster distortion. When straight-wound toroidal field deflection coil portions are used, the extent of barrel-shape of the magnetic field is comparatively low so that the resulting EW pin cushion distortion turns out to be comparatively low (8% is typical).

Figure 7:
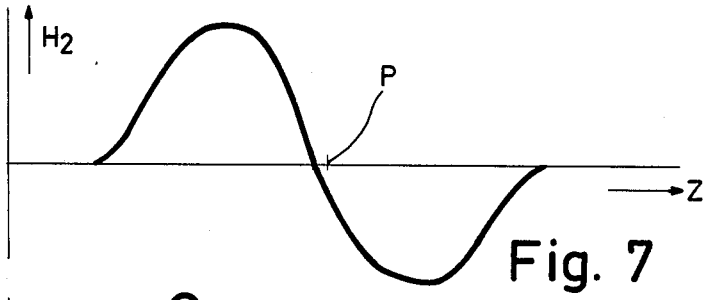

A possible way of correcting the coma error is to wind the toroidal field deflection coil portions "obliquely". Herewith it can be achieved that the field on the neck side of the field deflection coil becomes pin cushion-shaped so that the coma is pre-corrected as it were for the coma influence of the barrel-shaped magnetic field farther-on at the display screen end of the deflection unit. The variation of the magnetic field parameter $H_2$ will then be as indicated in FIG. 7. The zero-crossing of $H_2$ lies near the deflection center P. The integrated value is now small. In order to arrive at a good astigmatism level when obliquely wound coil portions are used, the field magnetic field at the screen end of the unit must be much more strongly barrel-shaped then when straight-wound field-deflection coil portions are used, so that these coils produce a greater pin cushion-shaped EW-raster distortion (in this case 14% is typical).

As regards the field shapes which can be generated and the results with respect to astigmatism, coma and raster defects, roughly the same conclusions hold for field deflection coils with coil portions of the saddle type as described for the toroidal field deflection coils.

At a given axial position the configuration of the produced magnetic field is determined by the distribution of the conductors of the coil in the corresponding part of the coil between the front end and the rear end. A measure of this distribution is the "average window opening". The window opening is expressed as the opening angle $\theta$ with respect to the axis of the deflection unit. A saddle coil having a constant average window opening which is constant along the Z-axis generates an $H_2$ function which is analogous to that of a straight-wound toroidal coil portion. A saddle coil having an average window opening which varies along the Z-axis may generate an $H_2$ function which is analogous to that of an "obliquely" wound toroidal field deflection coil. This means that for a saddle-shaped field deflection coil wih varying window opening, it also holds that since the field deflection coil is made coma-free a larger EW-raster distortion will be the result than when coma is permitted.

Figure 8:
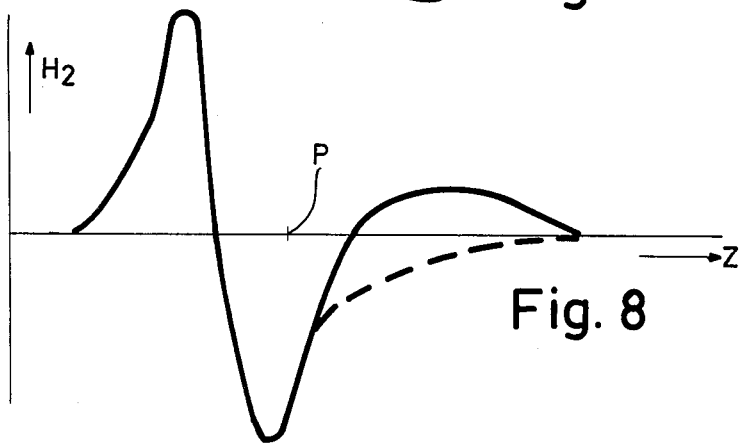
FIG. 8 shows diagrammatically the value of the parameter $H_2$ along the Z-axis of a display tube having a deflection unit according to the invention.

An acceptably small coma error, a good astigmatism level and a promotion of a less pin cushion-shaped EW-raster distortion can be obtained by a variation of the field parameter $H_2$ as shown in FIG. 8. The average value of $H_2$ is small so that the coma error can be acceptably small. The strongly negative value in the middle of the deflection field, that is to say near the deflection center produces in the first instance an astigmatism level which is too high, but a positive variation of $H_2$ at the display screen end of the field, as denoted by the solid line in the right-hand part of FIG. 8, can reduce the astigmatism to a favourable level. A positive variation of $H_2$ (hence a weak pin cushion-like field) also stimulates a barrel-shaped EW-raster distortion. Therefore, with the variation of the parameter $H_2$ of the field deflection magnetic field denoted by the solid line the resulting EW-raster distortion of a complete deflection unit designed for an "in-line" display system can be considerably less pin cushion-shaped than the raster distortion which, in otherwise the same circumstances, can be achieved wih the variation of $H_2$ shown in FIG. 7.

A variation at the display screen end as denoted by the broken line in FIG. 8 is slightly less optimum but still more favourable than the variation shown in FIG. 7. In that case $H_2$ is not positive but negative (or even zero) which is inherent in a weakened barrel-shaped and an undistorted field, respectively. This, too, results in a less pin chusion-shaped raster distortion than that to which the $H_2$ variation of FIG. 7 gives rise.

Figure 9:
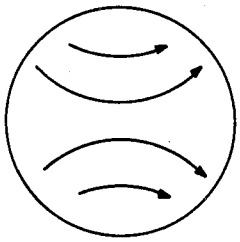
FIGS. 9, 10, 11 show the field deflection magnetic fields generated by the deflection unit according to the invention.
Figure 10:
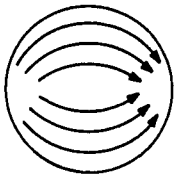
Figure 11:
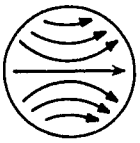

Within the scope of the invention, the desired variation of $H_2$ can be realised in a very practical manner by means of the magnetic flux altering means formed by the segments 9, 10 which are shown in FIGS. 3 and 4 and which are provided between the line deflection coil 7 and the field deflection coil 8 and which may be constructed as slightly curved segments of soft-magnetic material. By accommodating them near the center of the field deflection coil 8, mainly the astigmatism level of the field deflection coil 8 is influenced and the coma error is influenced to a smaller extent. The strongly negative peak in the variation of the parameter $H_2$, in which a barrel-shaped distortion of the field deflection magnetic field is inherent (FIG. 10), is obtained by the orientation of the flux altering means parallel to the magnetic field of the field deflection coil 8. FIGS. 9 and 11, respectively, show the little pronounced pin cushion shaped field generated at the screen end of the deflection unit 5 and the pronounced pin cushion-shaped magnetic field generated on the neck side of the deflection unit 5. The influence on the astigmatism level of the field deflection coil 8 is expressed as less "overfocusing" or more "underfocusing" of the two outermost beams relative to each other.

The influence of the flux altering means on the astigmatism error of the field deflection coil 8 is such that segments, having a length in the axial direction of 10 to 15 mm, and dimensions in the circumferential direction of 20 to 30 mm, used in a 26 inch display tube, (thick neck) may give rise to an astigmatism correction of 5 to 10 mm if they are positioned to substantially surround the field deflection center.

For the good operation of the flux altering means, it is essential that they be placed in the field deflection field in an axial position where the electron beams have already experienced some deflection. As a result of this, the beams will also be influenced by field components which are of a higher order than those described with the parameter $H_2$. On the other hand, said higher-order field components near the magnetic flux altering means are greatly influenced by said magnetic flux altering means. In other words: in addition to the influence on what is known as the "third-order behaviour" of the field deflection coil 8 by the magnetic flux altering means, there is also an influence on the higher-order behaviour. Notably there is influence on errors which are known as "anisotropic coma" and "anisotropic" astigmatism. The sensitivity of the behaviour of the deflection coil to the detail structure of the magnetic flux altering means increases with increasing "order" of the behaviour. For adjusting a correct "higher order" behaviour, several embodiments are therefore realisable of magnetic flux altering means which nevertheless always give the same influence on the "third order" behaviour. Feasible is inter alia the splitting up of the magnetic flux altering means into several parts, both in the direction of the Z-axis and in the circumferential direction. Furthermore, variations of shape on the rectangular basic form shown are possible.

What is claimed is:

1. A deflection unit for a color television display tube having a neck portion, a display screen and a funnel central portion therebetween, said deflection unit comprising a core, a pair of vertical deflection coils, and a pair of horizontal deflection coils, said pair of vertical deflection coils having a winding distribution for producing, when the deflection unit is mounted on said display tube, a pin cushion-shaped vertical deflection field at the neck side of the unit and a homogeneous vertical deflection field at the screen side of the deflection unit, said deflection unit further comprising flux altering means which, in combination with said pair of vertical deflection coils, produce a sharp barrel-shaped vertical deflection field at the central portion of the unit for correcting astigmatism distortion.

2. A deflection unit as claimed in claim 1, wherein the flux altering means comprise two soft-magnetic elements which are accommodated diametrically opposite to each other between the vertical and horizontal deflection coils, substantially parallel to the magnetic field of the vertical deflection coil near the center of the vertical deflection coil.

3. A deflection unit as claimed in claim 2, wherein said two soft-magnetic elements are each formed in a substantially flat segment, said segments being provided at a previously determined distance from each other.

4. A deflection unit as claimed in claim 3, wherein at least one further segment in the radial direction is associated with each segment.

5. The combination of a deflection unit as claimed in claim 1, 2, 3 or 4 with a color television display tube having a neck portion, a display screen and an intermediate cup-shaped outer surface, in which the deflection unit comprises a horizontal deflection coil consisting of two diametrically oppositely located horizontal deflection coil portions each formed from electrical conductors which are wound so as to form a first and a second side strip, a front and a rear end, which together define a window opening, at least the front end being bent away from the longitudinal axis of the display tube and being situated more adjacent to the display screen than the rear end, the flux altering means being arranged so that they influence the vertical deflection field, but have negligible effect on the horizontal deflection field.

* * * * *